US009687031B2

(12) United States Patent
Turner

(10) Patent No.: US 9,687,031 B2
(45) Date of Patent: Jun. 27, 2017

(54) STABILITY ENHANCED SHORTS WITH STITCHING

(71) Applicant: Nike, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 980 days.

(21) Appl. No.: 13/866,427

(22) Filed: Apr. 19, 2013

(65) Prior Publication Data

US 2013/0298306 A1 Nov. 14, 2013

Related U.S. Application Data

(60) Provisional application No. 61/636,366, filed on Apr. 20, 2012.

(51) Int. Cl.

| | |
|---|---|
| ***A41D 1/08*** | (2006.01) |
| ***A41D 31/00*** | (2006.01) |
| ***A41D 13/00*** | (2006.01) |

(52) U.S. Cl.

CPC ..... *A41D 1/08* (2013.01); *A41D 13/0015* (2013.01); *A41D 31/00* (2013.01)

(58) Field of Classification Search

CPC ..... A63B 21/4025; A63B 21/4043; A41D 2400/38; A41D 13/0015

See application file for complete search history.

(56) References Cited

U.S. PATENT DOCUMENTS 1,508,834 A * 9/1924 Cohen ..... A41D 27/10 2/125
1,968,832 A * 8/1934 Hinchliff ..... A61F 13/08 2/239

(Continued)

FOREIGN PATENT DOCUMENTS

CN 101868158 A 10/2010
DE 202004011705 U1 10/2004

(Continued)

OTHER PUBLICATIONS

International Search Report and Written Opinion for PCT/US2013/037414 of Aug. 1, 2013 filed Apr. 19, 2013.

(Continued)

*Primary Examiner* — Richale Quinn
(74) *Attorney, Agent, or Firm* — Shook, Hardy & Bacon L.L.P.

(57) ABSTRACT

Form-fitting athletic garments may provide different elasticity and therefore different amounts of support along different directions. A relatively elastic textile may be used to form a form-fitting compressive garment such as shorts, shirts, leggings, bodysuits, socks, and the like. Stitch lines may be formed in the relatively elastic textile extending in a desired direction using thread(s) and/or stitch construction techniques to provide reduced elasticity along the direction of a stitch line. One or more stitch lines may be formed in a textile to provide enhanced support along the direction of the stitch line(s). An interior textile layer may be adhered the relatively elastic textile layer to contact the wearer's skin and to protect the wearer's skin from stitch lines. An interior textile layer may extend over all or part of the relatively textile layer.

17 Claims, 6 Drawing Sheets

(56) References Cited

U.S. PATENT DOCUMENTS 2,071,569 A * 2/1937 Rand ..... A41B 9/04 2/401
2,334,206 A * 11/1943 Knohl ..... D04B 1/26 2/239
2,343,374 A * 3/1944 Hargreaves ..... A41F 9/02 2/237
2,610,496 A * 9/1952 Kostopoulos ..... A41B 9/06 2/113
2,736,036 A * 2/1956 Sinigagliesi ..... A41B 9/04 2/405
3,083,710 A * 4/1963 Rauser ..... A41B 9/02 2/401
3,245,410 A * 4/1966 Martin ..... A41C 1/003 2/DIG. 9
3,279,469 A * 10/1966 Schustack ..... A41C 1/003 2/408
3,301,261 A * 1/1967 Farino ..... A41C 1/10 450/104
3,338,776 A * 8/1967 Blair ..... A41C 1/02 2/407
3,359,571 A * 12/1967 Burke ..... A41F 11/18 2/240
3,778,845 A * 12/1973 Miller ..... A41F 9/00 2/236
5,033,117 A * 7/1991 Fairweather ..... A63B 21/065 2/227
5,201,074 A * 4/1993 Dicker ..... A41D 13/0015 2/227
5,758,363 A 6/1998 Winfree
5,875,491 A * 3/1999 Wilkinson ..... A41D 13/0015 2/227
6,004,891 A * 12/1999 Tuppin ..... A41D 31/0061 139/408
6,401,497 B1 6/2002 Nishiyama et al.
6,874,337 B2 * 4/2005 Uno ..... A41D 1/08 2/401
7,730,552 B2 * 6/2010 Ota ..... A41D 13/0015 2/227
7,941,871 B1 * 5/2011 Jorgensen ..... A41D 7/005 2/228
8,555,415 B2 * 10/2013 Bradstreet ..... A41D 1/08 2/220
8,578,512 B2 * 11/2013 Moore ..... A41D 13/012 2/2.15
2008/0194181 A1 * 8/2008 Sudo ..... A41C 1/003 450/123
2011/0209263 A1 9/2011 Suzuki et al.
2012/0000007 A1 1/2012 Hansen
2012/0036615 A1 * 2/2012 Bradstreet ..... A41D 1/08 2/236
2012/0186000 A1 * 7/2012 Raviv ..... A41D 27/205 2/247
2015/0196067 A1 * 7/2015 Blakely ..... A41D 13/0015 2/69

FOREIGN PATENT DOCUMENTS

EP 2401930 A2 1/2012
WO 9843506 A1 10/1998
WO 2009114899 A1 9/2009

OTHER PUBLICATIONS

European Search Report dated Feb. 12, 2016 in Application No. 13777552.4, 7 pages.

* cited by examiner

STABILITY ENHANCED SHORTS WITH STITCHING

CROSS-REFERENCE TO RELATED APPLICATIONS

This application, claims benefit of U.S. Provisional Application No. 61/636,366, filed Apr. 20, 2012, entitled "Stability Enhanced Shorts With Stitching." The aforementioned application is incorporated by reference herein.

STATEMENT REGARDING FEDERALLY SPONSORED RESEARCH OR DEVELOPMENT

Not applicable.

TECHNICAL FIELD

The present invention relates to athletic garments. More particularly, the present invention relates to close fitting garments that provide stability to an athlete wearing the garment by limiting the ability of the garment to stretch in one or more directions while still permitting relatively easy stretching along other directions.

BACKGROUND OF THE INVENTION

Athletes in various sports often prefer to wear base layer garments during training and/or competition. Base layer garments may take a variety of forms, but often are highly elastic garments that provide some degree of form-fitting compression, thereby permitting the base layer garments to be worn beneath other layers of athletic garments. For example, base layer garments such as shirts and shorts may be worn by American football players beneath pads and external uniform garments to prevent chafing by outer layers of the athletic apparel and/or to provide enhanced comfort, protection, stability, or other benefits to the athlete wearing the base layer garment.

BRIEF SUMMARY OF THE INVENTION

The present invention provides an elastic and stretchable base layer garment that may be worn for training and/or competition by an athlete. A garment in accordance with the present invention may be worn by itself or under other garments as a base layer. A garment in accordance with the present invention may comprise shorts, a shirt, leggings, a bodysuit, socks, or any other type of garment worn for athletic training and/or competition. Particularly described examples of garments in accordance with the present invention are shorts and a shirt, but garments in accordance with the present invention may comprise any other type of garment.

A garment in accordance with the present invention may comprise at least a first layer of a textile. The first textile layer may comprise a first layer of an elastic textile. One example of textiles that may be used in garments in accordance with the present invention are textiles incorporating some proportion of stretchable fibers such as spandex. At least a first stitch line extending in a first direction along a first textile may be formed using a thread having an elasticity lower than the elasticity of the first textile. A second stitch line may extend in a second direction along the first textile. The second stitch line may be formed using a thread having an elasticity lower than the elasticity of the first textile. Any number of additional stitch lines may be formed in the first textile. While the first stitch line, the second stitch line, and any further stitch lines may be formed using the same type of thread and stitch type(s) to create similar elasticities, different types of thread, different stitch counts, and/or different stitching techniques/sizes/structures (potentially made using different machines) may be utilized to provide different elasticity values for different stitch lines. In addition or alternatively to individual stitch lines, pluralities of stitch lines may be used. The number of stitch lines, proximity of stitch lines, relative orientation of stitch lines, and the types of stitches and/or threads used in the stitch lines may be selected for any given desired plurality of stitch lines to select the desired amount of motion control for a particular garment and/or zone on a garment. For example, at least a first plurality of stitch lines extending in a substantially parallel fashion in a first direction along the first textile may be formed using a thread having an elasticity lower than the elasticity of the first textile. A second plurality of stitch lines may also be formed in the first textile extending in a substantially parallel fashion along a second direction. Further pluralities of stitch lines may be provided as desired. Alternatively/additionally, pluralities of stitch lines may be substantially non-parallel, for example radiating from a common point or point of a garment to provide support around the corresponding point on an athlete's body when the garment is worn. Stitch lines may extend along directions in which, when the garment is worn, support is desired by the athlete wearing the garment. Support, in the form of resistance to movement or stretch, is provided by a garment in accordance with the present invention along the axis parallel to a stitch line, while less support but more freedom of movement is provided along an axis perpendicular to a stitch line. Thus, movement by an athlete along desired directions are encouraged, while movement along less desired directions are discouraged. While support provided by a garment in accordance with the present invention may result due to the mechanical strength and resistance to stretching of one or more stitch lines, such support may alternatively/additionally arise from the feedback the resistance by one or more stitch lines to stretching provides to the athlete wearing the garment. For example, the resistance to stretching in a given direction by one or more stitch line may provide a proprioceptive indication to the athlete wearing the garment to avoid over extension, improper posture, poor form, etc. Multiple stitch lines or pluralities of stitch lines extending along different axes may be provided, so as to provide support along different directions of a worn garment. Different zones of a garment may have stitch lines extending in different directions to provide support in the direction(s) desired at different places desired by the athlete wearing the garment.

Garments in accordance with the present invention may further utilize a second textile layer adhered to the first textile layer. For example, adhesives may be used to laminate a second textile layer to the skin facing surface of the first textile layer with one or more stitch lines to prevent one or more of those stitch lines formed in the first textile layer from contacting the skin of the athlete wearing the garment. An interior textile layer may comprise the same or different type of fabric as the exterior textile layer. An interior textile layer may be affixed to the exterior textile layer in fashions other than lamination and/or using adhesives, such as by stitching at external hems or using stitches to tack the layers of fabric together at varying locations. Further, an interior textile layer, if used, need not be co-extensive with the exterior textile layer and need not cover all stitch lines provided by the exterior textile layer. By strategically positioning an interior textile layer, the type of fabric selected for use as an interior textile layer, and the use of additional stitch lines in an interior textile layer, the amount of support and/or freedom of movement provided in a specific zone of a garment may be further determined.

BRIEF DESCRIPTION OF THE SEVERAL VIEWS OF THE DRAWING

The present invention is described in detail below with reference to the attached drawings, figures, wherein.

DETAILED DESCRIPTION OF THE INVENTION

Garments in accordance with the present invention may provide stitch lines with less elasticity than the textile(s) used to form the garment. One or a plurality of stitch lines may limit the stretch of the garment along the direction(s) of the stitch line(s) to provide additional support to an athlete wearing the garment. On the other hand, stretch of the garment along a direction(s) substantially perpendicular to the one or plurality of stitch lines is limited by the elasticity of the textile used for the garment rather than the stitch line(s). Further, pluralities of stitch lines may provide support in concert. For example, a plurality of stitch lines extending in a substantially parallel fashion may provide support in concert along the direction that the plurality of stitch lines extend. Thus, a garment in accordance with the present invention provides support in one or more directions without restricting movement in other directions without bulky components or complicated construction.

Figure 1:
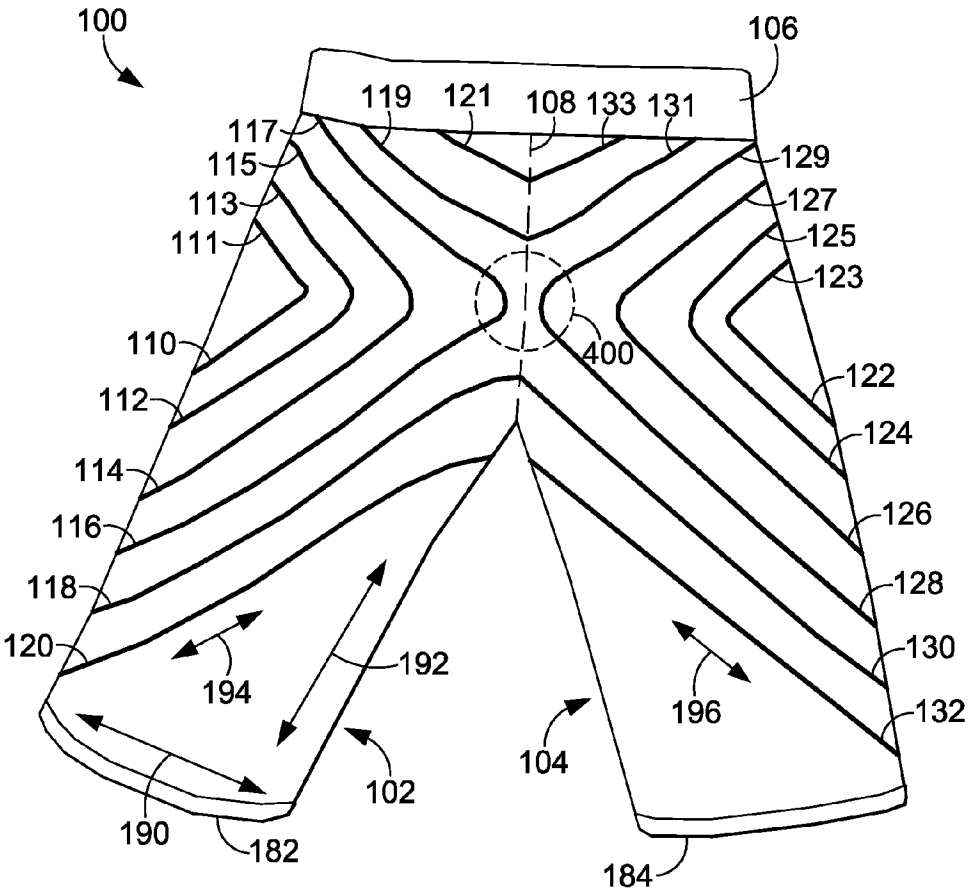
FIG. 1 illustrates a front view of an example of shorts in accordance with the present invention.

Referring now to FIG. 1, an example of shorts 100 in accordance with the present invention are illustrated. FIG. 1 illustrates a front view of shorts 100 as worn by an athlete (not shown). Shorts 100 may comprise a right leg 102 and a left leg 104 as worn. While shorts 100 may be constructed of any number of textile panels, in the example shown in FIG. 1 right side 102 as worn is constructed from a single textile while left side 104 is formed of another single piece of textile, with right side 102 and left side 104 being joined along a crotch line 108 and, optionally, any gussets or similar components to optimize fit on an athlete. Any type of woven or knit textile of any natural or synthetic fiber may be used for right side 102 and/or left side 104 of shorts 100. Textiles incorporating materials such as spandex, latex, or other elastic fibers or materials may be used, but any type of woven or knit textile may be used in accordance with the present invention. Any sort of acceptable hem or seam may be used to terminate right side 102 and/or left side 104 at the terminal edge of the leg of shorts 100. As the example shorts 100 shown in FIG. 1 are form fitting, right side 102 terminates with elastic hem 182, which serves as an anchor point to prevent right side 102 of shorts 100 from moving up the thigh (not shown) of a wearer. Similarly, left side 104 of shorts 100 may terminate with elastic hem 184 that serves as an anchor point to prevent left side 104 of shorts 100 from moving up the thigh (not shown) of a wearer. An elastic waistband 106 is illustrated on shorts 100, but any sort of waistband, such as a drawstring, may be utilized for shorts in accordance with the present invention. As illustrated in the example of FIG. 1, the right side 102 of shorts 100 has two pluralities of stitch lines. Similarly, left side 104 of shorts 100 has two pluralities of stitch lines corresponding in a symmetrical fashion to the stitch lines on opposing right side 102 of shorts 100. While the present example illustrates garments providing symmetrical support characteristics and, therefore, substantially symmetrical stitch lines on the opposing sides of a garment, in this example shorts 100, non-symmetrical support may be provided on garments in accordance with the present invention if desired, which may utilize non-symmetrical stitch lines. Further, different numbers of stitch lines may be used to provide support in a garment in accordance with the present invention. For example, a single stitch line may provide sufficient support for some garments, athletes, or sports.

Right side 102 of shorts 100 comprises a first plurality of stitch lines extending substantially from the lower left of shorts 100 to the upper right of shorts 100 as viewed from the front of shorts 100 in an as worn position, as illustrated in the example of FIG. 1. While this first plurality of stitch lines may comprise any number of stitch lines, or even a single stitch line, in the example illustrated in FIG. 1 first plurality of stitch lines on right side 102 of shorts 100 comprises first stitch line 110, second stitch line 112, third stitch line 114, fourth stitch line 116, fifth stitch line 118, and sixth stitch line 120. Still referring to the example of FIG. 1, right side 102 of shorts 100 has a second plurality of stitch lines extending in a substantially different direction than first plurality of stitch line. In the illustrated example of FIG. 1 the second plurality of stitch lines on the right side 102 of shorts 100 extend from the upper left of shorts 100 towards the lower right of shorts 100 in an as worn position. As shown in the example illustrated in FIG. 1, the second plurality of stitch lines on the right side 102 of shorts 100 comprises first stitch line 111, second stitch line 113, third stitch line 115, fourth stitch line 117, fifth stitch line 119, and sixth stitch line 121. In the example illustrated in FIG. 1, each of the first plurality of stitch lines has a corresponding stitch line in the second plurality of stitch lines. Some of these pairs of stitch lines meet at an end point of each of the pair of stitch lines. Such one-to-one correspondence of stitch lines in different pluralities extending in different directions may be advantageous, but is not necessary in garments in accordance with the present invention. Multiple pluralities of stitch lines are not necessary for garments in accordance with the present invention. Moreover, even if multiple pluralities of stitch lines are used, no one-to-one correspondence of stitch lines and their location or orientation is necessary in accordance with the present invention.

Referring still to the example of FIG. 1, shorts 100 also comprise a left-hand side 104 with a first plurality of stitch lines corresponding symmetrically to the first plurality of stitch lines on the right side 102 of shorts 100, namely first stitch line 122, second stitch line 124, third stitch line 126, fourth stitch line 128, fifth stitch line 130, and sixth stitch line 132. Similarly, left-hand side 104 of shorts 100 may also have a second plurality of stitch lines extending in a different direction than first plurality of stitch lines and generally corresponding symmetrically to the second plurality of stitch lines on the right-hand side 102 of shorts 100. This second plurality of stitch lines on left-hand side 104 of shorts 100 in the example illustrated in FIG. 1 comprise first stitch line 123, second stitch line 125, third stitch line 127, fourth stitch line 129, fifth stitch line 131, and sixth stitch line 133. The precise number and orientation of stitch lines may be varied without departing from the scope of the present invention.

A garment in accordance with the present invention, such as the example of shorts 100 depicted in FIG. 1, may be constructed of a fabric having a first elasticity, while the various pluralities of stitch lines may be constructed from a plurality of individual stitches formed using a thread(s) with a second elasticity, which may be less than the first elasticity of the fabric used to construct shorts 100. By way of further example, different stitch lines of the various pluralities of stitch lines may use different types of threads having different elasticities, thereby providing different support and/or resistance to movement along different directions for the wearer of shorts 100 and/or different support and/or resistance to movement in a single direction at different locations along a garment. The elasticity of different stitch lines may be varied by using different types of stitching and different constructions of individual stitches along differing pluralities of stitch lines or in different stitch lines of the same plurality. The elasticity of a single stitch line may be varied along that stitch line by varying the properties of the stitches along that stitch line.

The stretchability of shorts 100 along different directions are depicted graphically in FIG. 1 by arrows indicating how much the shorts 100 may stretch in different directions when worn. For example, in a substantially horizontal direction, the shorts 100 may have a reasonably high amount of elasticity, as indicated by arrow 190. Similarly, in a substantially vertical direction shorts 100 may have a similarly relatively high amount of elasticity as indicated by arrow 192. In the present example depicted in FIG. 1, the stretch along the horizontal direction indicated by arrow 190 and the stretch along the vertical direction indicated by arrow 192 are not aligned with either the first plurality of stitch lines or the second plurality of stitch lines, of either right side 102 or left side 104 of shorts 100 and therefore the elasticity along line 190 and line 196 is limited primarily by the elasticity of the fabric from which shorts 100 are constructed. As indicated by arrow 194 extending in substantially the same direction as first plurality of stitch lines of right side 102 and second plurality of stitch lines of left side 104 and arrow 196 extending in substantially the same direction as second plurality of stitch lines of right side 102 and first plurality of stitch lines of left side 104, the elasticity of shorts 100 in directions substantially parallel to the pluralities of stitch lines is sharply limited. This limitation of elasticity along the axis parallel to the stitch lines is due to the lower elasticity of the thread used in the stitches of the plurality of stitch lines, which is the limiting factor in the elasticity of shorts 100 in those directions. The arrows indicating stretch in the example of FIG. 1 are not necessarily to scale and are intended to demonstrate that the stretch permitted by a garment is different in different directions rather than the magnitude of any difference.

Figure 2:
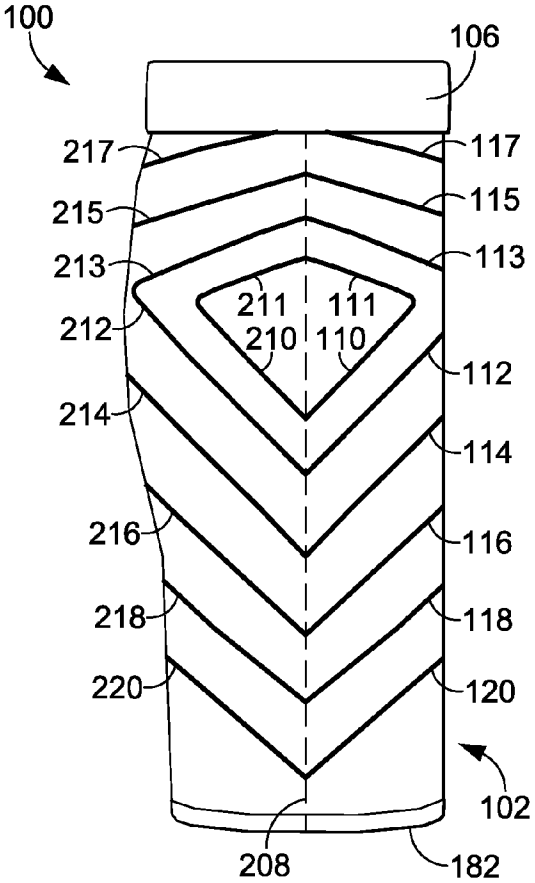
FIG. 2 illustrates a side view of the example of shorts in accordance with the present invention.

Referring now to FIG. 2, a side view of shorts 100 is illustrated. In the example illustrated in FIG. 2, the right side 102 of shorts 100 are depicted, although left side 104 may also be inferred from the right side 102 illustrated in FIG. 2 for the symmetrical example of shorts 100 depicted and described herein. A vertical line 208 is illustrated in FIG. 2 to illustrate the substantial middle portion of the thigh and hip of shorts 100 when worn. A seam may be employed substantially along middle line 208, but need not be used if the entire right side 102 is constructed of a single piece of textile as described herein. Left side 104 may similarly be constructed with a seam along its middle line, but no such seam is necessary. As shown in FIG. 2, each of the plurality of stitch lines on the right side 102 of front of shorts 100 and described in conjunction with FIG. 1 may have a corresponding stitch line of a plurality of seam lines on the back of shorts 100. While the example illustrated in FIG. 2 is substantially symmetrical from the front to the rear of shorts 100, such symmetry is not necessary in accordance with the present invention. In the example illustrated in FIG. 2, a first plurality of stitch lines on the back of the right side 102 of shorts 100 may comprise a first stitch line 210, a second stitch line 212, a third stitch line 214, a fourth stitch line 216, a fifth stitch line 218, and a sixth stitch line 220. Similarly, a second plurality of stitch lines on back of right side 102 of shorts 100 may comprise a first stitch line 211, a second stitch line 213, a third stitch line 215, and a fourth stitch line 217. Pairs of stitch lines on the front and back of shorts 100 may comprise one continuous stitch line or discrete stitch lines. For example, stitch line 120 may simply continue into stitch line 220, or each of stitch line 120 and stitch line 220 may be formed with separate stitches.

Figure 3:
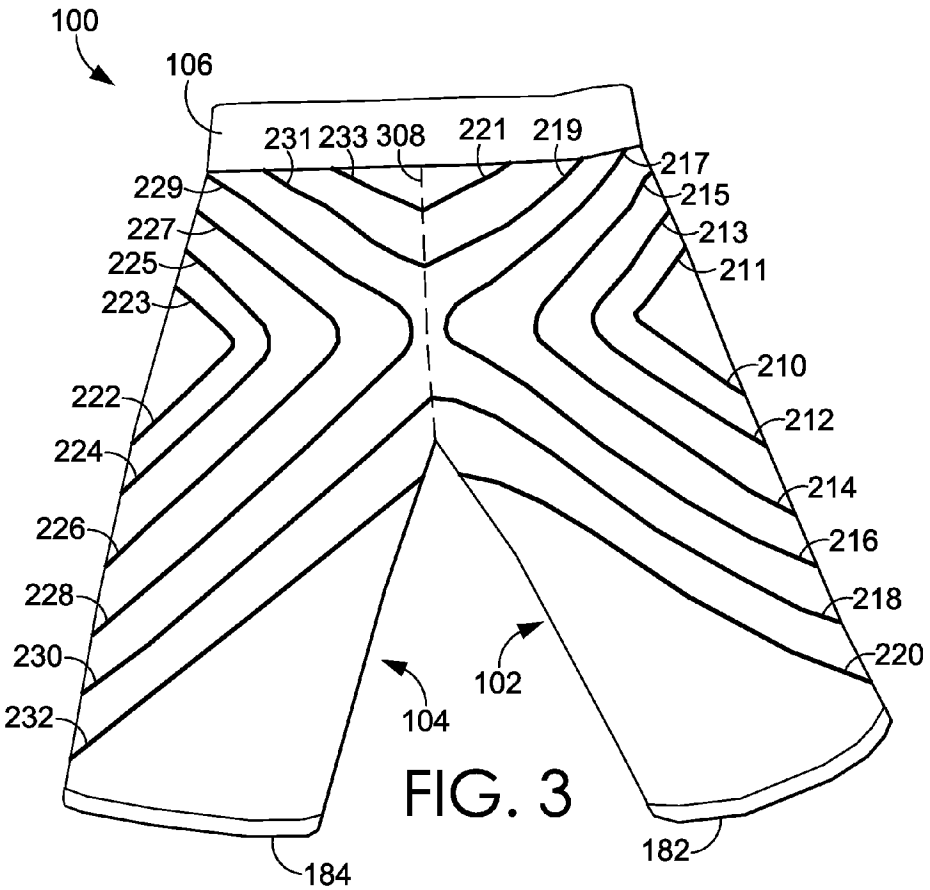
FIG. 3 illustrates a back view of the example of shorts in accordance with the present invention.

Referring now to FIG. 3, a rear view of shorts 100 in an as-worn position is illustrated. The rear view of shorts 100 depicted in FIG. 3 is substantially symmetrical as compared to the front view of shorts 100 depicted in FIG. 1, but such symmetry from front to rear is not necessary in garments in accordance with the present invention. As shown in the example of FIG. 3, shorts 100 comprise a right side 104 and a left side 102 as worn joined by a crotch seam 308. Crotch seam 308 in the rear may be continuous with crotch seam 108 in the front of shorts 100, or may be formed as distinct stitches in the formation of shorts 100. Right side of shorts 104 may comprise a first plurality of stitch lines extending along a first direction, such as stitch line 210, second stitch line 212, third stitch line 214, fourth stitch line 216, fifth stitch line 218, and sixth stitch line 220. Right side 104 of shorts 100 may also have a second plurality of stitch lines extending along a second direction, such as first stitch line 211, second stitch line 213, third stitch line 215, fourth stitch line 217, fifth stitch line 219, and sixth stitch line 221. Similarly, left side 102 of shorts 100 may comprise a first plurality of stitch lines extending substantially along a first direction, such as first stitch line 222, second stitch line 224, third stitch line 226, fourth stitch line 228, fifth stitch line 230, and sixth stitch line 232. Further, left side 102 of shorts 100 may comprise a second plurality of stitch lines extending substantially along a second direction, such as first stitch line 223, second stitch line 225, third stitch line 227, fourth stitch line 229, fifth stitch line 231, and sixth stitch line 233. As described above with regard to the front view of shorts 100 depicted in FIG. 1, the various stitch lines and pluralities of stitch lines illustrated in the example rear view of FIG. 3 may permit greater elasticity of shorts in directions not aligned with the stitch lines and with decreased elasticity and, therefore, greater support in directions aligned with pluralities of stitch lines.

Figure 4:
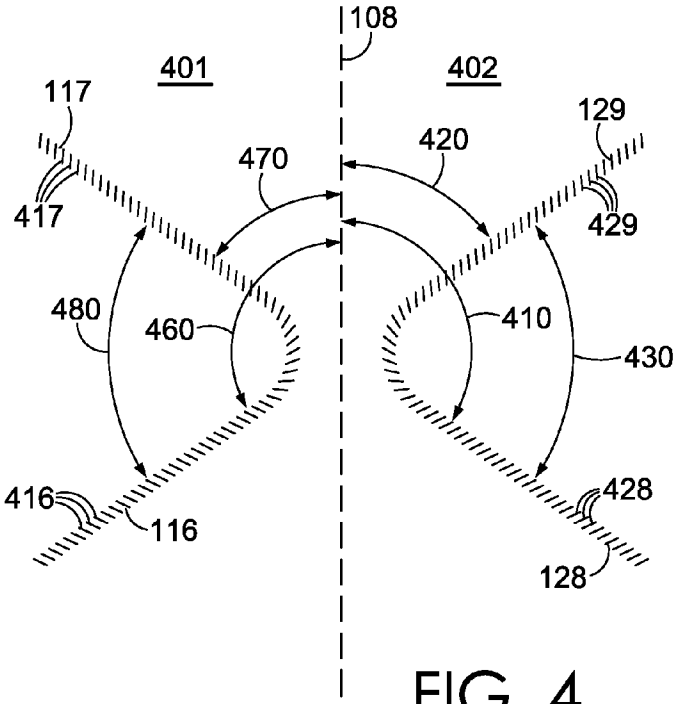
FIG. 4 shows a close-up view of an example of stitch lines on an example of shorts in accordance with the present invention.

Referring now to FIG. 4, a detailed view of stitch lines in accordance with the present invention is illustrated. FIG. 4 illustrates a closer view of stitches depicted on the front view of shorts 100 shown in the example of FIG. 1. For example, stitch line 116 is shown as comprising a plurality of individual stitches 416, while stitch line 117 is shown as comprising a plurality of individual stitches 417. Both stitch line 116 and stitch line 117 may be made using thread that penetrates textile 401 on right side 102 of shorts 100 as worn. Textile 401 on right side 102 of shorts may be affixed along crotch seam 108 to textile 402 on left side 104 of shorts 100 as worn. Left side of shorts 100 may have stitch line 128 comprised of a plurality of individual stitches 428 and stitch line 129 comprised of a plurality of individual stitches 429. The individual stitches in stitch line 128 and stitch line 129 may penetrate the textile 402 of left side 104 of shorts 100.

Still referring to FIG. 4, the relative orientation of various stitch lines may be described in various fashions. For example, stitch line 116 may be described as having a given angle 460 from a vertical reference line, such as crotch seam 108, while stitch line 117 may be described as having a second angle 470 from vertical reference line, such as crotch seam 108. Alternatively/additionally, stitch line 116 may be described as having an angle 480 with stitch line 117. Further, stitch lines such as stitch line 116 and/or stitch line 117 may be described as having a particular angle relative to a horizontal reference line, such as waistband 106. By way of yet further example, one or more stitch lines may be oriented relative to one or more anatomical points of reference on an athlete when a garment is worn. In a similar fashion, stitch line 128 may have a first angle 410 with regard to the vertical reference line, such as crotch seam 108. Similarly, stitch line 129 may be at a second angle 420 relative to the vertical reference line, such as crotch seam 108. Alternatively/additionally, stitch line 128 may be described as being at a certain angle 430 relative to stitch line 129. Further, stitch line 128 and/or stitch line 129 may be described as being at a given angle to the horizontal reference line, such as waistband 106 and/or an anatomical reference point when the garment is worn.

Figure 5:
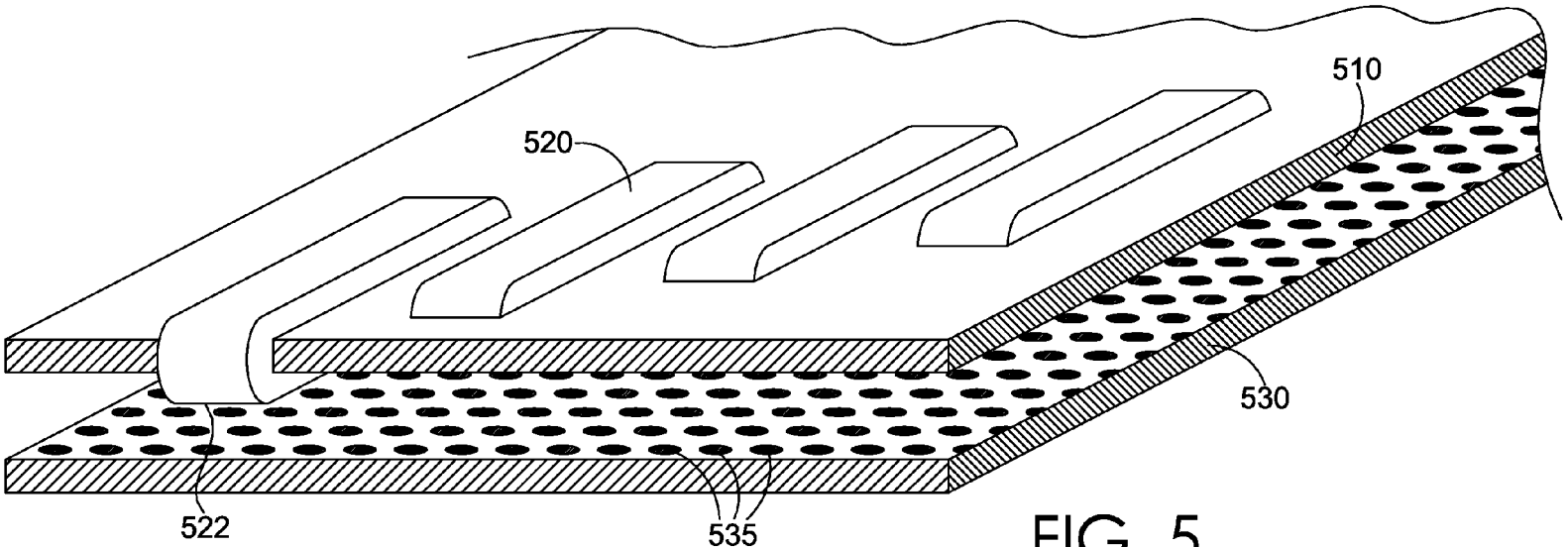
FIG. 5 shows an example of layers of a garment in accordance with the present invention.

Referring now to FIG. 5, layers of textile that may be used in constructing a garment in accordance with the present invention, such as the example shorts 100 depicted in FIGS. 1-3, are illustrated. A first textile layer 510 may comprise, for example, an elastic woven or knitted material. For example, first textile layer 510 may comprise spandex or a textile comprising a percentage of spandex content. A plurality of stitches such as stitch 520 may penetrate first textile layer 510. As described above, the thread and/or construction of stitches 520 may provide lower elasticity along those stitches 520 than would be provided by first textile layer 510, which may be referred to as an exterior textile layer, on its own. Individual stitches in a stitch line may be oriented parallel to the direction of the stitch line, perpendicular to the direction of the stitch line, or at any other angle relative to the direction of the stitch line. The thread used to form stitches 520 may comprise any type of synthetic or natural fiber. Further, the thread used to form stitches may comprise a thread having any type of construction. For example, the thread may comprise a twisted thread if greater mechanical elasticity is desired or a non-twisted fluff thread if less mechanical elasticity is desired. The elasticity of a stitch line may vary based upon parameters such as the type of thread (s) used to form stitches, the type of stitch(es) used (i.e., stitch structure, number of threads used, size of a stitch and/or the components of a stitch), the orientation of stitches relative to a stitch line, and/or the stitch count/density of stitches used in a given linear distance. If a plurality of stitch lines are used, the relative orientation, number, and/or density of stitch lines in any given plurality of stitch lines may also be varied. Stitch line parameters may vary at different zones of a garment or even along a given stitch line.

In the example illustrated in FIG. 5, first textile 510 may be thought of as comprising an exterior layer away from the skin of a wearer when the garment is worn. A second textile layer 530 may be affixed to first textile layer 510. Second textile layer 530 may be referred to as an interior textile layer and may be affixed to first textile layer 510 so as to cover any interior thread 522 from stitches 520 to prevent chafing or other annoyance of skin of a wearer (not shown). While interior layer 530 may be affixed to exterior layer 510 in any fashion, in the example depicted in FIG. 5 a plurality of adhesive dots 535 are provided on the face of interior textile layer 530 that will be contacting exterior textile layer 510. Adhesive dots 535 may comprise any type of adhesive and may be of any size, shape, orientation, etc. Adhesive dots 535 may be subsequently activated, if activation is needed, to affix the exterior layer 510 to the interior layer 530. For example, a heat press may activate adhesive dots 535 by applying appropriate heat and pressure for a sufficient duration of time to melt adhesive dots 535 and bond exterior textile layer 510 to interior textile layer 530, but other methods of adhesive activation may be used. The use of adhesive dots 535 rather than a continuous layer of adhesive permits enhanced breathability through interior textile layer 530 and exterior textile layer 510, but a continuous layer of adhesive may be used. Any desired adhesive, whether continuous or in an intermittent array to promote breathability of the resulting garment, may be pre-applied to one or both layers of textiles, such as depicted for interior textile layer 530 in the example depicted in FIG. 5. Alternatively, an adhesive layer may be inserted between an exterior textile layer 510 and an interior textile layer 530 as a separate component in the construction of the garment. For example, an adhesive film may be individually prepared and inserted, either as a continuous sheet, a layer with punch-outs or perforations to promote breathability, or as a plurality of adhesive pieces during the construction of a garment. Alternatively/additionally, liquid adhesives, such as glues or epoxies, may be applied at desired locations to affix two textile layers, or stitches or mechanical fasteners may be used.

Figure 6:
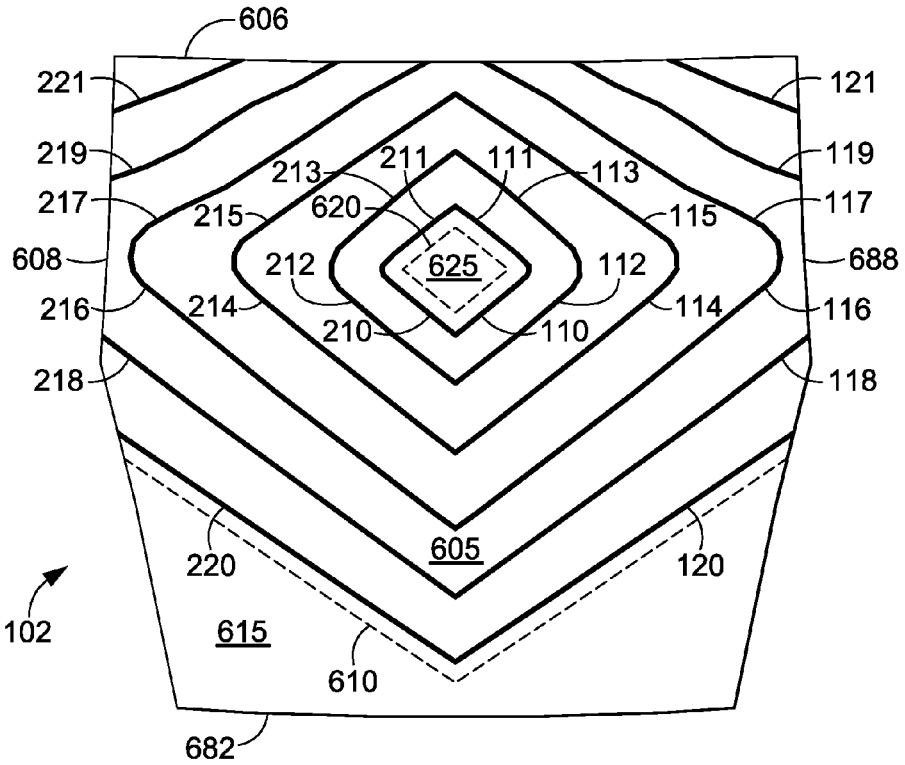
FIG. 6 illustrates an example of a textile panel that may be used to create one side of shorts in accordance with the present invention.

Referring now to FIG. 6, a further example of how an interior layer may be selectively applied to a garment in accordance with the present invention is illustrated. In the example of FIG. 6, a textile panel that will correspond to right leg portion 102 of shorts 100 may have stitch lines as described above. The edges 610, 620 of an interior panel are shown in phantom. The edges 610 of the interior panel create a two layered section 605 where an interior panel covers the stitch lines and a first one layered section 615 below the bottommost stitch lines 120, 220 and a second one layered section 625 within central stitch lines 110, 11, 210, 211. In the present example, second one layer section 625 corresponds to the hip (not shown) of an athlete when the shorts 100 are worn, but a one layered section, if desired, may be employed at any location on a garment.

Figure 7:
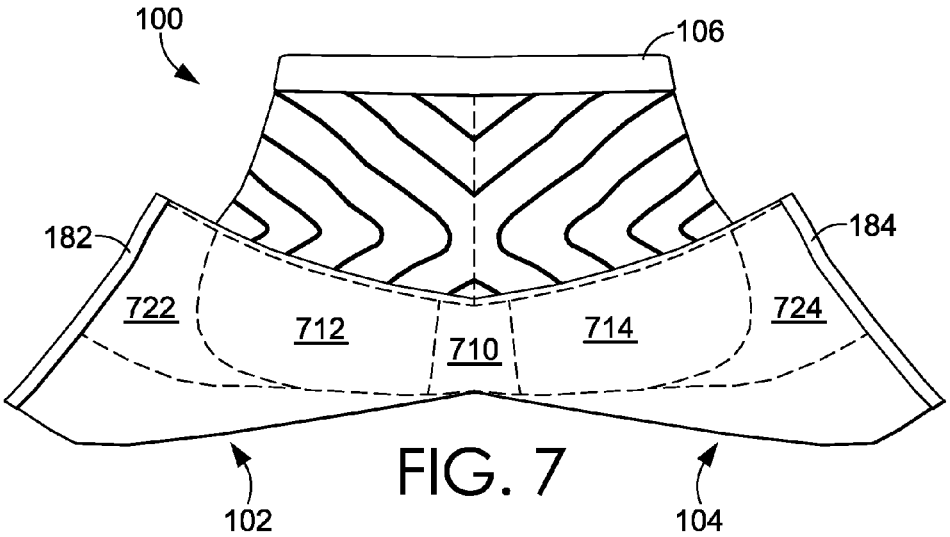
FIG. 7 illustrates an example of optional inseam gussets that may be used in shorts in accordance with the present invention.

Referring now to FIG. 7, the optional use of gussets to provide improved fit for shorts 100 in accordance with the present invention are illustrated. In the example of FIG. 7, a central gusset 710, a first right gusset 712, a second right gusset 722, a first left gusset 722, and a second left gusset 724 are provided, but other numbers, types, and/or configurations of gussets may be used in garments in accordance with the present invention.

Figure 8:
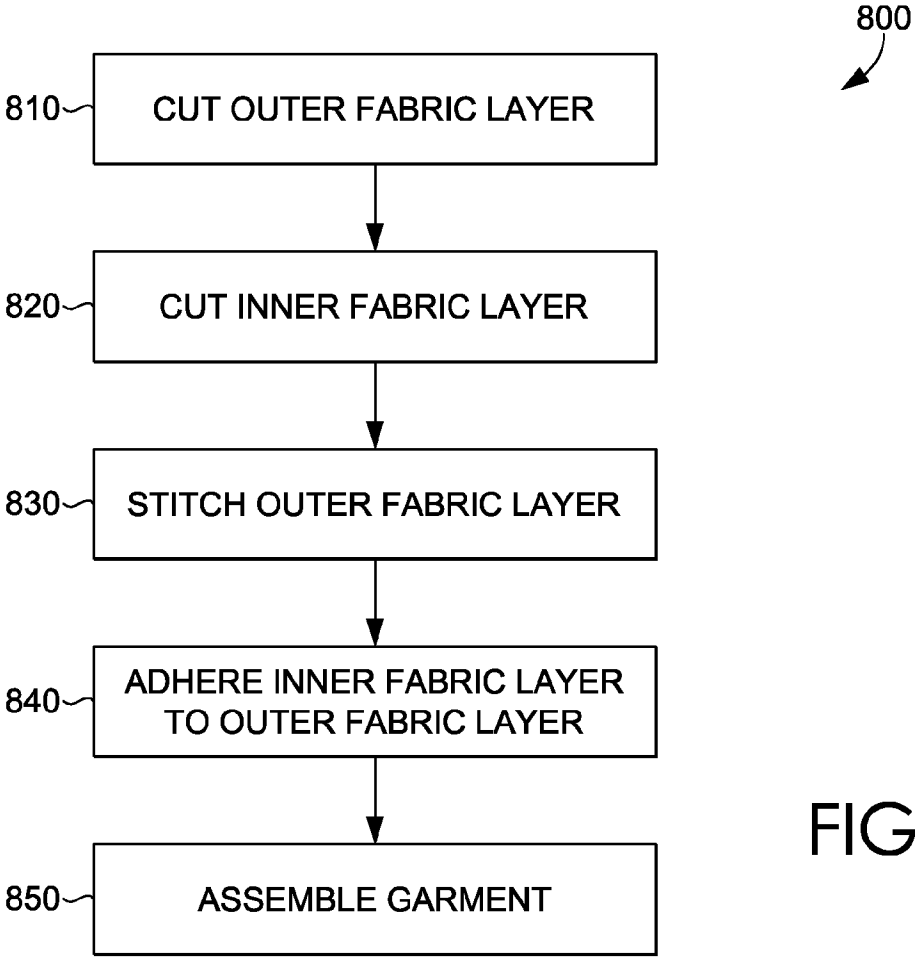
FIG. 8 illustrates an example of a method for forming a garment in accordance with the present invention.

Referring now to FIG. 8, a method 800 for constructing a garment in accordance with the present invention is illustrated. In step 810 the outer fabric layer may be cut from a larger portion of the fabric. For example, the right and left portions of shorts may be cut from a larger piece of textile in step 810. Step 810 may use any type of cutting die, scissors, knife, blade, laser, water jet, say, etc. to cut the desired pieces. In step 820 an inner fabric layer, if desired, may be cut. As with step 810, any type of cutting device, technology, or technique may be used in step 820. Step 820 may be omitted if no interior fabric layer is desired, but if an interior fabric layer such as the example described above with regard to FIG. 5 and/or FIG. 6 is desired, that fabric layer may be cut to correspond to one or more of the piece(s) cut in step 810 or to correspond to a desired zone or region of the piece(s) cut in step 810. In step 830, pluralities of stitches may be formed in the outer fabric layer to create stitch lines. Any type of stitching may be used in step 830. Example of appropriate stitch types are flat seams and cover stitches, but any type of stitch may be used. Further, step 830 may form stitches using any type of synthetic or natural fiber-based thread. Step 830 may be performed to create one or more pluralities of stitch lines in one or more of the fabric pieces cut for the outer fabric layer in step 810. Optionally, stitches may be similarly formed in an inner fabric layer, if such a layer is present and if such stitches are desired. In step 840, the inner fabric layer, if used, may be adhered to the outer fabric layer. Step 840 may be omitted if no inner fabric layer is desired. Step 840 may use a heat press to activate an adhesive, whether present as preformed on the face of one or more of the fabric layers cut in step 810 and/or 820, or separately inserted. Alternatively or additionally, step 840 may comprise affixing an inner fabric layer to an outer fabric layer at edges or at various points within the interior of a fabric panel, whether using adhesives, stitching, ultrasonic welding, or any other fastening technology. In step 850 the garment is assembled. Step 850 may comprise, for example, affixing a left side of a pair of shorts to a right side of a pair of shorts at a crotch seam, as well as any other appropriate hemming or attaching of a waistband or other finishing elements to the garment. Further, any desired ornamentation, tags, etc. may be affixed to the garment, if desired.

Figure 9:
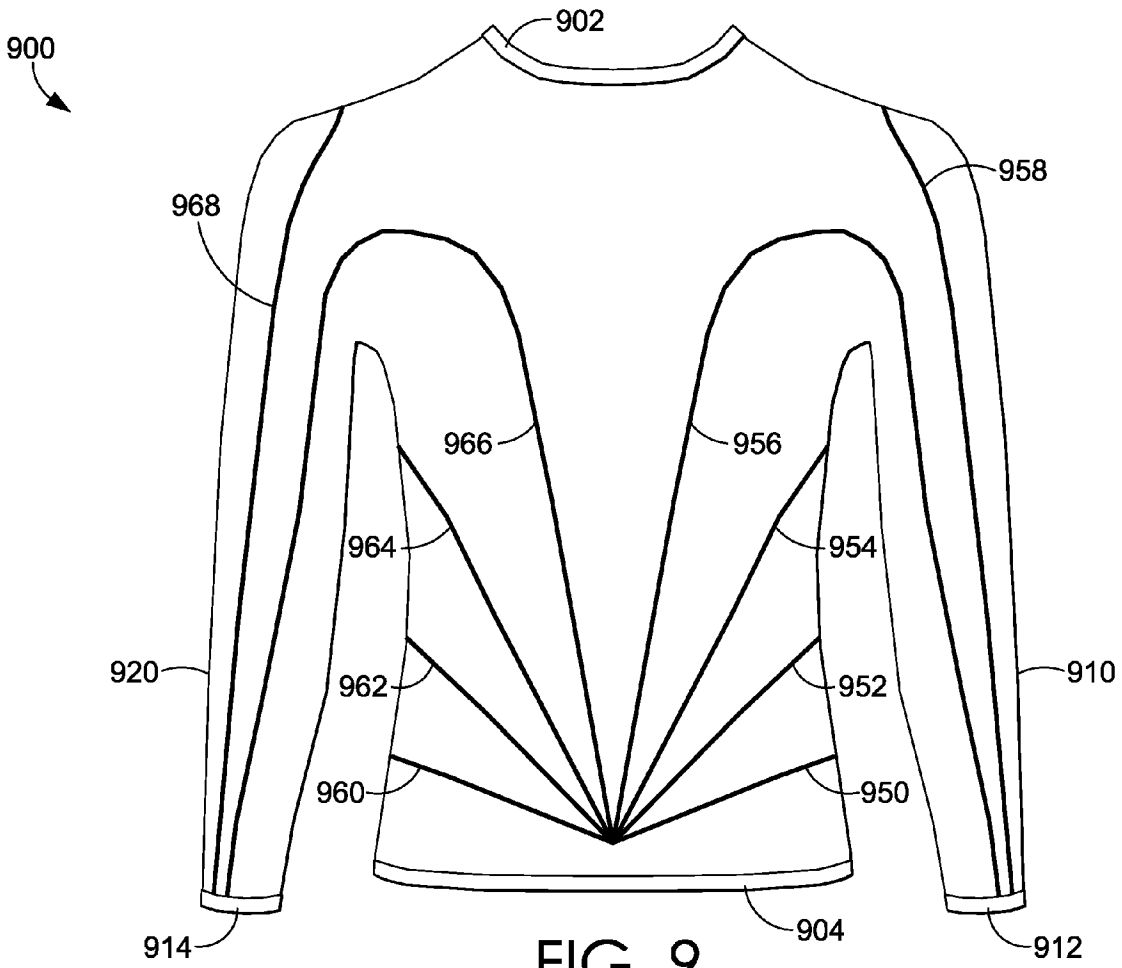
FIG. 9 illustrates an example of a shirt in accordance with the present invention.

Referring now to FIG. 9, an example shirt 900 in accordance with the present invention as viewed from the rear as worn is illustrated. Shirt 900 may have a neck hem 902, a waist hem 904, a right wrist hem 912, and a left wrist hem 914 with sufficient elasticity to provide anchor points for shirt 900. Shirt 900 may also comprise a first set of radiating stitch lines 950, 952, 954, 956 providing support to the right side of a wearer's back. Shirt may further comprise a second set of radiating stitch lines 960, 962, 964, 966 providing support to the left side of a wearer's back. A further right stitch line 958 may extend along right sleeve 910 provide support for the wearer's right arm, and a further left stitch line 968 may extend along left sleeve 920 to provide support for the wearer's left arm.

While garments in accordance with the present invention may be constructed from multiple textile pieces, all or part of a garment may be knitted in its final or substantially final form. If a garment is knitted in its final or substantially final form, stitch lines may be created after knitting or during knitting by introducing threads/yarns for stitch lines during the knitting process.

While a specific example of shorts and a shirt in accordance with the present invention has been described herein, the present invention is not limited to these examples. Garments in accordance with the present invention may comprise any type of garment, such as leggings, body suits, socks, shorts, shirts, etc. Any type of woven or knit textile may be used to form a garment in accordance with the present invention, and any type of thread applied with any type of stitching technique may be used to form stitch lines to provide support for garments in accordance with the present invention. Stitch lines may be applied in parallel, radiating, or other groups of stitch lines having different frequencies/densities having different elasticity properties. A garment in accordance with the present invention may have one or more group of stitch lines. Stitch lines and/or groups of stitch lines may be symmetrical or asymmetrical on a garment. Additional textile layers may optionally be applied to a garment in accordance with the present invention to cover stitch lines and/or further modify the support properties of the garment. If used, one or more additional textile layers may be affixed in any way. Additional textile layers may be of the same or different material as the textile layer with the stitch lines. By adjusting the textile(s) used, the threads used in stitch lines, the construction of stitch lines, the number of stitch lines, the orientation of stitch lines, and/or numbers and properties of additional textile layers, the support provided by a garment in accordance with the present invention may be finely controlled.

Having thus described the invention, what is claimed is:

1. A close fitting athletic garment comprising:

a front portion divided from a rear portion by a midline reference plane;

at least a first fabric layer comprising a unitary textile, the first fabric layer having a first elasticity; and at least a first stitch line extending along the first fabric layer in a first direction and the at least first stitch line extending along the first fabric layer in a second direction, the at least first stitch line changing from the first direction to the second direction at the mid-line reference plane, the at least a first stitch line comprising a plurality of stitches formed from a first thread, the first thread having a second elasticity, the second elasticity being less than the first elasticity; and wherein:

the elasticity of the close fitting athletic garment is limited by the second elasticity of the first thread along the first direction and the second direction, and wherein the elasticity of the close fitting garment is limited by the first elasticity of the first fabric layer when the close fitting garment is stretched in a direction perpendicular to the first direction.

2. The close fitting athletic garment of claim 1, further comprising a second fabric layer, the second fabric layer affixed to the first fabric layer and positioned so as to contact the skin of a wearer when the garment is worn.

3. The close fitting garment of claim 2, wherein the garment comprises shorts having a waistband and two leg portions.

4. The close fitting garment of claim 3, wherein the at least a first stitch line comprises a plurality of stitch lines.

5. The close fitting garment of claim 4, wherein the plurality of stitch lines are symmetrical about an axis of the shorts corresponding to the crotch when the garment is worn.

6. The close fitting garment of claim 4, wherein the plurality of stitch lines are symmetrical about the mid-line reference plane when the garment is worn.

7. The close fitting garment of claim 2, wherein the garment comprises a shirt having a collar portion and two sleeve portions.

8. The close fitting garment of claim 7, wherein the at least a first stitch line extends along at least a portion of one of the two sleeve portions.

9. The close fitting garment of claim 8, wherein the at least a first stitch line comprises at least first stitch line extending along one of the two sleeve portions and a second stitch line extending along the other of the two sleeve portions.

10. A pair of compressive shorts that provides different resistance to stretch in different directions when worn by an athlete, the compressive shorts comprising:

a front portion divided from a rear portion by a midline reference plane;

an exterior layer of elastic fabric;

a first plurality of stitch lines extending substantially parallel in a spaced apart relationship in a first direction along the exterior layer, each of the first plurality of stitch lines extending from the midline reference plane in the first direction to the front portion, each of the first plurality of stitch lines formed from a first thread that penetrates the exterior layer of elastic fabric, the first thread being less elastic than the elastic fabric of the exterior layer;

a second plurality of stitch lines extending substantially parallel in a spaced apart relationship in a second direction different from the first direction along the exterior layer, each of the second plurality of stitch lines extending from the midline reference plane in the second direction to the front portion, each of the second plurality of stitch lines formed from a second thread that penetrates the exterior layer of elastic fabric, the second thread being less elastic than the elastic fabric of the exterior layer; and an interior layer of fabric affixed to the exterior layer of elastic fabric and positioned between the skin of a wearer and the first plurality of stitch lines and the second plurality of stitch lines when the shorts are worn.

11. The pair of compressive shorts of claim 10, wherein the first thread of the first plurality of stitch lines and the second thread of the second plurality of stitch lines do not penetrate the interior layer of fabric.

12. The pair of compressive shorts of claim 10, wherein at least one of the first plurality of stitch lines intersect at least one of the second plurality of stitch lines in the front portion when the shorts are in an as worn position.

13. The pair of compressive shorts of claim 12, further comprising:

a third plurality of stitch lines extending substantially parallel in a spaced apart relationship in a third direction along the exterior layer, each of the third plurality of stitch lines extending from the midline reference plane in the third direction to the rear portion, each of the third plurality of stitch lines formed from a third thread that penetrates the exterior layer of elastic fabric, the third thread being less elastic than the elastic fabric of the exterior layer; and a fourth plurality of stitch lines extending substantially parallel in a spaced apart relationship in a fourth direction along the exterior layer, each of the fourth plurality of stitch lines extending from the midline reference plane in the fourth direction to the rear portion, each of the fourth plurality of stitch lines formed from a fourth thread that penetrates the exterior layer of elastic fabric, the fourth thread being less elastic than the elastic fabric of the exterior layer.

14. The pair of compressive shorts of claim 13, wherein the first thread, the second thread, the third thread, and the fourth thread are comprised of the same material.

15. The close fitting garment of claim 13, wherein at least one of the third plurality of stitch lines intersect at least one of the fourth plurality of stitch lines in the rear portion when the shorts are in an as worn position.

16. The close fitting garment of claim 1, wherein at least one of the first plurality of stitch lines intersect at least one of the third plurality of stitch lines at the mid-line reference plane and wherein at least one of the second plurality of stitch lines intersect at least one of the fourth plurality of stitch lines at the mid-line reference plane.

17. The close fitting garment of claim 1, wherein the mid-line reference plane intersects a right vertical seam on a right side of the garment and a left vertical seam on a left side of the garment.

* * * * *